United States Patent [19]

Brown et al.

[11] Patent Number: 4,887,196

[45] Date of Patent: Dec. 12, 1989

[54] RECESSED TRACK LIGHTING SYSTEM

[75] Inventors: Tobias A. Brown, Oak Park; Scott L. Roos, Glenview; Donald D. Biancalana, Schaumburg; Donald J. Westgaard, Carol Stream, all of Ill.

[73] Assignee: Alkco Manufacturing Company, Franklin Park, Ill.

[21] Appl. No.: 257,761

[22] Filed: Oct. 14, 1988

[51] Int. Cl.[4] ..... F21S 1/02

[52] U.S. Cl. ..... 362/148; 362/250; 362/364; 362/373; 362/419

[58] Field of Search ..... 362/148, 364, 365, 287, 362/419, 373, 249, 250

[56] References Cited

U.S. PATENT DOCUMENTS

| | | | |
|---|---|---|---|
| 3,778,609 | 12/1973 | Liberman | 362/364 |
| 4,414,617 | 11/1983 | Galindo | 362/250 |
| 4,623,956 | 11/1986 | Conti | 362/148 |
| 4,729,080 | 3/1988 | Fremont et al. | 362/148 |

*Primary Examiner*—Ira S. Lazarus

*Assistant Examiner*—Richard R. Cole

*Attorney, Agent, or Firm*—Pasquale A. Razzano

[57] ABSTRACT

A recessed track lighting system includes a housing recessed in a ceiling and having a top wall, an elongated opening spaced downwardly from the top wall and a channel along the top wall extending parallel to the opening and laterally centered in respect thereto, and at least one light fixture mounted in the housing by means of an adapter releasably engageable in the channel and being movable therealong. The adapter defines an axis of rotation that substantially bisects the width of the elongated opening and a lamp head support in turnable about such axis of rotation and has an arcuate guide extending generally radially from the axis of rotation. The arcuate guide has a curvature centered substantially at the lateral center of the elongated opening, and a lamp head is adjustably mounted on the arcuate guide and includes a light source directing light along a light beam axis which, in all positions of the lamp head along the arcuate guide, intersects the axis of rotation at the plane of the opening.

18 Claims, 7 Drawing Sheets

FIG. 3
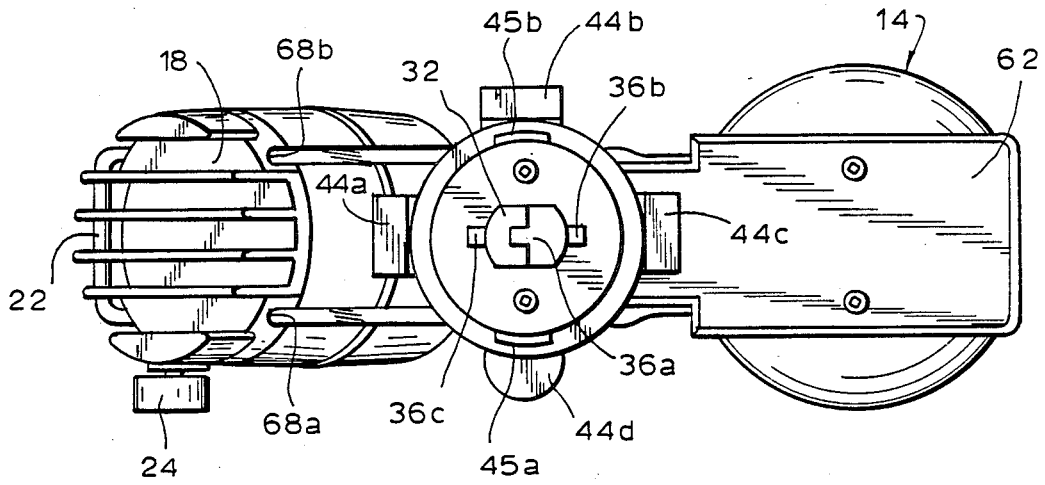
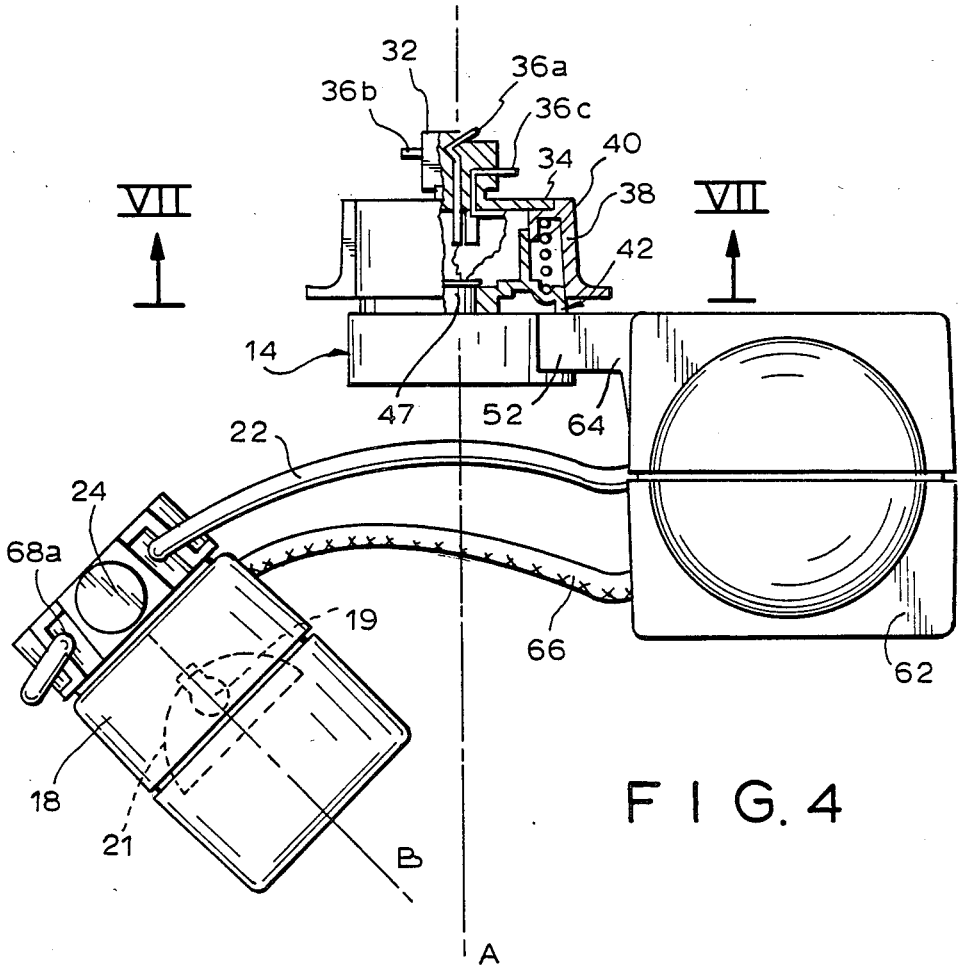
FIG. 4

RECESSED TRACK LIGHTING SYSTEM

BACKGROUND OF THE INVENTION

1. Field of the Invention

This invention relates generally to track lighting systems and more particularly, to a track lighting system that may be recessed in a ceiling.

2. Description of the Prior Art

It is known in the prior art to provide accent lighting for a space either by so-called recessed rounds with hidden adjustable light sources or by track lighting. Recessed rounds are often chosen because they can be inconspicuous sources of light. The placement of a recessed fixture, however, must be precisely planned, often in advance of full knowledge of the nature and placement of interior furnishings. Also, once installed, the location of a recessed light source is fixed. This limits the fixture's ability to adapt to changes in the arrangement and use of a space.

Track lighting systems offer much more flexibility in terms of fixture placement and aiming adjustability, but often their physical projection into a space is not desirable or appropriate for a particular design scheme.

Further, it is known, as disclosed in U.S. Pat. No. 4,086,480, granted Apr. 25, 1978, to provide an integrated suspension ceiling and recessed lighting system in which a fluorescent light fixture is supported primarily on arched bridging members which extend between parallel runs of the grid of a suspension ceiling. The bridging members also support a continuous channel which permits the fixture to be wired therein. However, even in the foregoing arrangement, the light fixture is stationary thereby providing an inflexible system not adaptable to changes in the use and arrangement of a space.

Further, it is known, as disclosed in U.S. Pat. No. 4,025,777 granted May 24, 1977, to provide an apparatus for clinical illumination of an operating room wherein the foci of the light emanating from the lamps are located on the surface to be illuminated. The foci of the lamps can be shifted by movement along a horizontal line and by varying the depth of the lamps. However, the lamps are not angularly displaceable and therefore, this arrangement provides an inflexible system that is not easily adaptable to changes in the arrangement of a space. Further, the light sources of this arrangement are located at the plane of a ceiling rather than recessed above it.

OBJECTS AND SUMMARY OF THE INVENTION

Accordingly, it is an object of this invention to provide a recessed track lighting system which avoids the above described disadvantages of the prior art and, more particularly, provides a flexible system that is capable of adapting to changes in the arrangement of a space and is adaptable to any ceiling construction.

It is a further object of this invention to provide a recessed track lighting system which is capable of illuminating a subject anywhere within a relatively wide area, for example, a circular area with a diameter approximately twice the ceiling height.

In accordance with an aspect of this invention, a recessed track lighting system comprises a housing adapted to be recessed in a ceiling and including a top wall, means defining an elongated opening spaced downwardly from the top wall, and means defining a channel along the top wall extending parallel to the elongated opening and laterally centered in respect thereto; and at least one light fixture adapted to be mounted within the housing, including adapter means releasably engageable in the channel and being movable along the latter, the adapter means defines an axis of rotation that substantially bisects the width of the elongated opening, a lamp head, lamp head support means rotatable around the axis of rotation and including arcuate guide means extending generally radially from the axis of rotation and having a curvature centered substantially at the lateral center of the opening, and means for mounting the lamp head on the arcuate guide means for adjustable movement therealong, the lamp head having a light source directing light along a light beam axis which, in all positions of the lamp head along the arcuate guide means, intersects the axis of rotation at the plane of the opening.

The above, and other objects, features and advantages of this invention, will be apparent in the following detailed description of the illustrative embodiment thereof which is to be read in connection with the accompanying drawings and in which corresponding parts are identified by the same reference numerals in the several views.

BRIEF DESCRIPTION OF THE DRAWINGS

FIG. 3 is a top plan view of a light fixture included in the systems of FIGS. 1 and 2;

FIG. 4 is an enlarged side elevational view of the light fixture included in the system of FIGS. 1 and 2, and with an adapter assembly thereof being shown in axial section;

DESCRIPTION OF A PREFERRED EMBODIMENT

Figure 1:
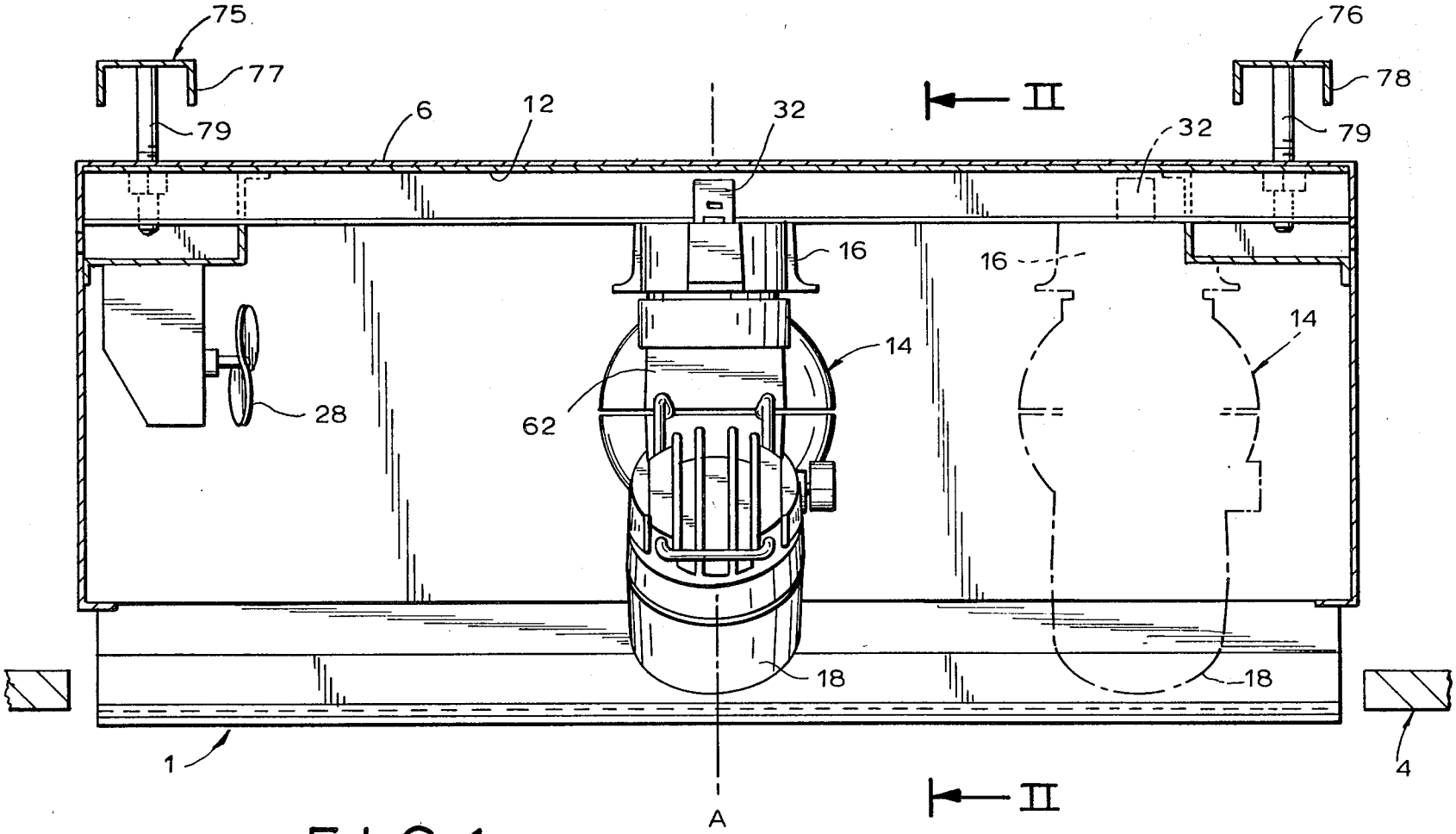
FIG. 1 is a longitudinal sectional view of a recessed track lighting system according to an embodiment of this invention.

Referring initially to FIG. 1, it will be seen that a recessed track lighting system 1 in accordance with an embodiment of the present invention generally comprises a substantially rectangular housing 2 recessed above a dropped ceiling 4. The housing 2 is shown to include a top wall 6 and a bottom wall 8. The bottom wall 8 has an elongated opening 10 extending therealong and the top wall 6 includes a channel 12 which extends parallel to the elongated opening 10 and is laterally centered in respect thereto. The recessed track lighting system, further comprises at least one light fixture 14 mounted within the housing 2 by way of an adapter assembly 16 which is releasably engageable in the channel 12 and is movable along the latter.

Figure 2:
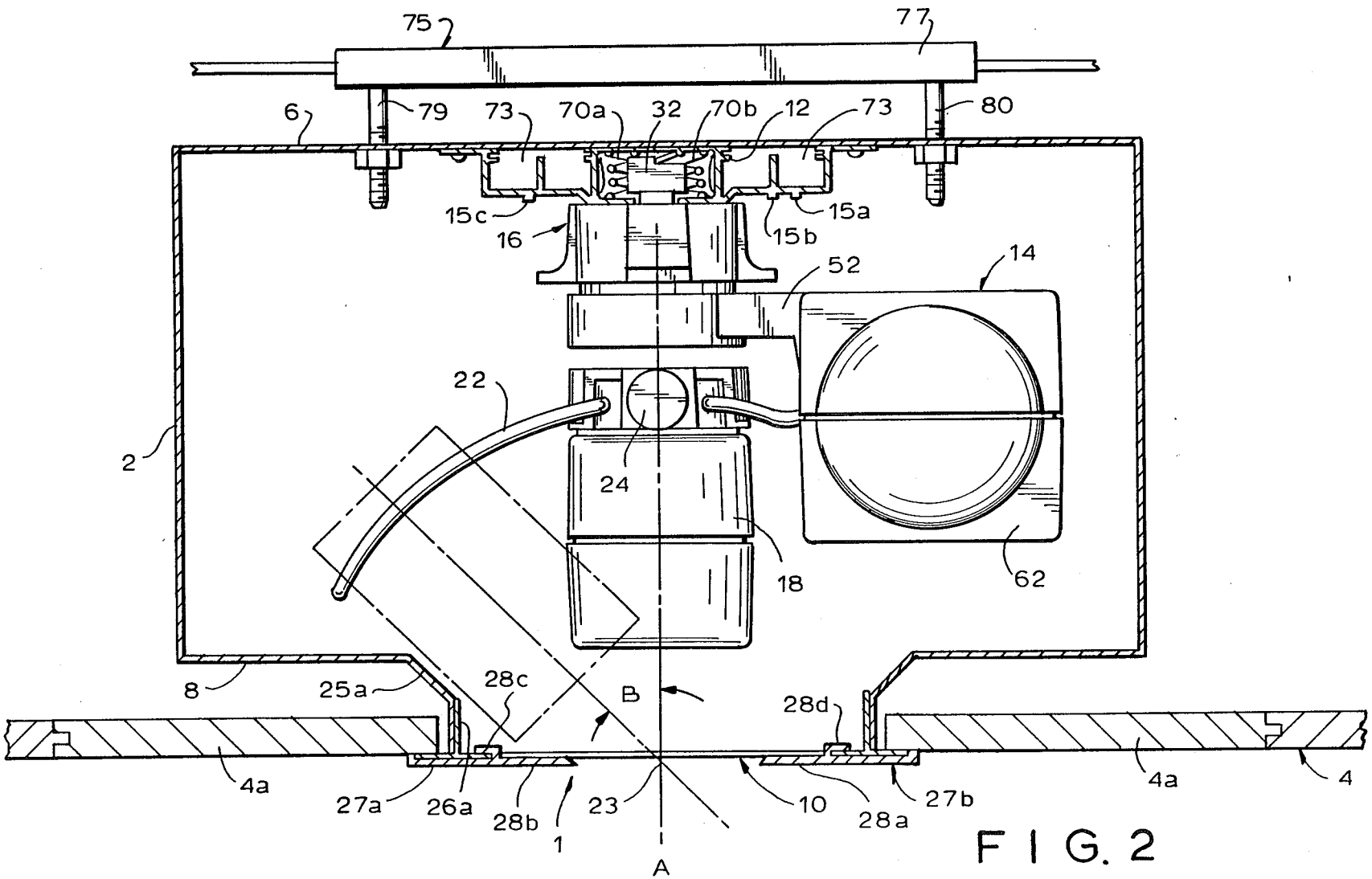
FIG. 2 is a vertical sectional view taken along line II—II of FIG. 1.

As seen in FIG. 2, the adapter assembly 16 defines an axis of rotation A that substantially bisects the width of the elongated opening 10. Each light fixture 14 further includes a lamp head 18, and a lamp head support 20 which is rotatable around the axis of rotation A and has an arcuate guide 22 extending generally radially from the axis of rotation A and having a center of curvature 23 substantially at the lateral center of the opening 10 (FIG. 2). The lamp head 18 which is adjustable along this arcuate guide 22, as hereinafter described in detail, has a light source for example, indicated in broken lines at 19 on FIG. 4, directing light along a light beam axis B which, in all positions of the lamp head 18 along the arcuate guide 22, intersects the axis of rotation A at the plane of the elongated opening 10. Preferably, the light beam from source 19 is directed, as by a reflector also indicated in broken lines at 21 on FIG. 4, to a focal point corresponding to the center 23 of the curvature of the guide 22, so as to be in the plane of the opening 10.

Referring back to FIG. 2, the bottom wall 8 of the housing 2 has two downwardly extending converging portions 25*a* and 25*b* leading to contiguous inverted T-bars 26*a* and 26*b*, respectively. The inner edges of the horizontal portions of the inverted T-bars 26*a* and 26*b* define the opposite side margins of the opening 10. As shown, adjacent tiles 4*a* of the dropped ceiling 4 are supported on the outwardly directed edge portions of the T-bars 26*a* and 26*b*.

Further shown in FIG. 2 are trim members 27*a* and 27*b* which are slidably mounted on inverted T-bars 26*a* and 26*b* respectively. The trim members 27*a* and 27*b* each have a horizontal surface 28*a* and 28*b* and an upwardly extending C-shaped portion 28*c* and 28*d* respectively. Each of these C-shaped portions 28*c* and 28*d* retain leaf spring cups (not shown), the leaf spring cups engage the inverted T-bars 26*a* and 26*b* respectively, of housing 2 for a purpose hereinafter described.

Figures 5, 8A:
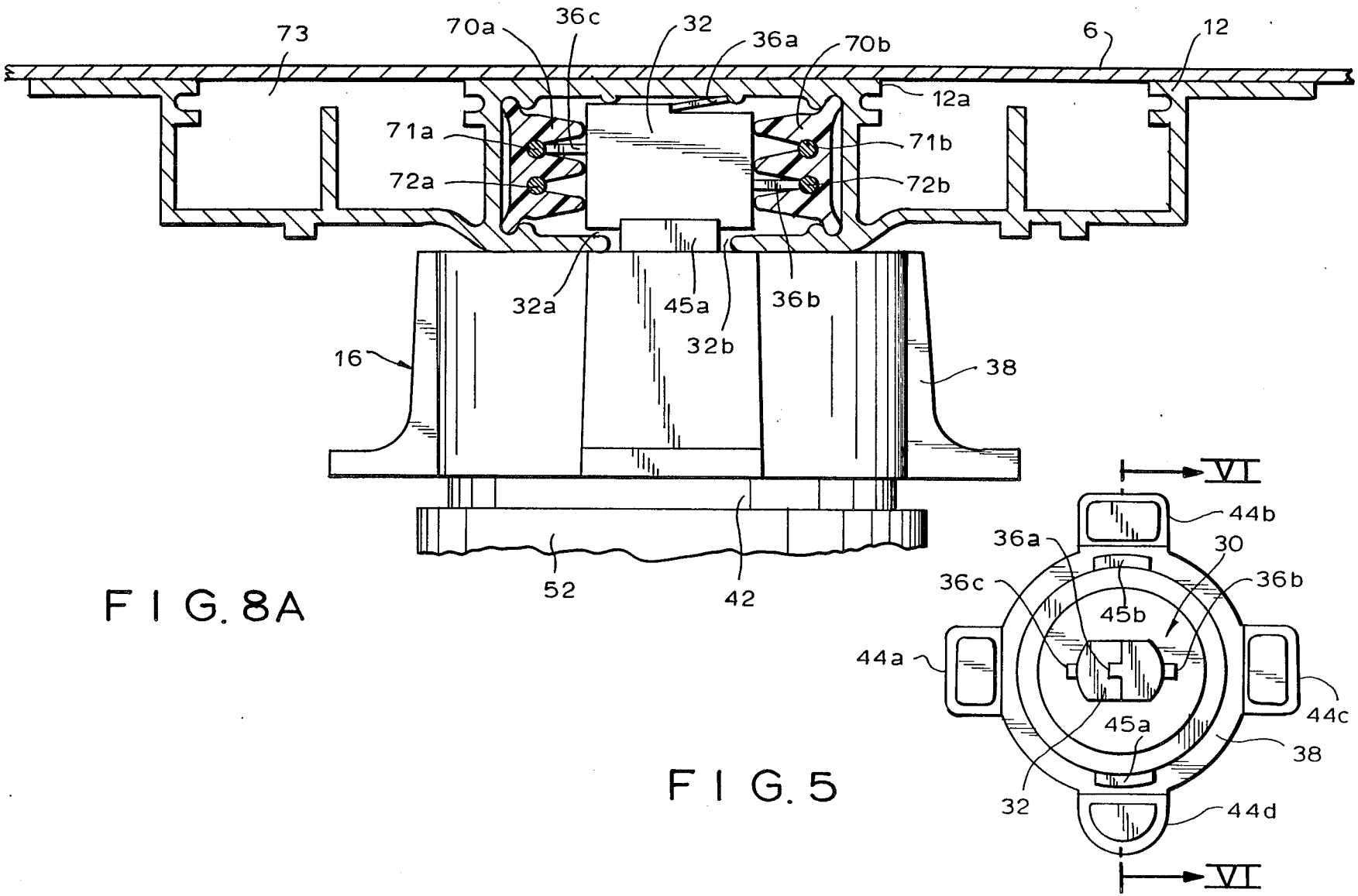
FIG. 5 is a top plan view of the adapter assembly.
FIG. 8A is a cross sectional view of a housing channel and contacts of the adapter assembly engaged therein in a first position.
Figure 6:
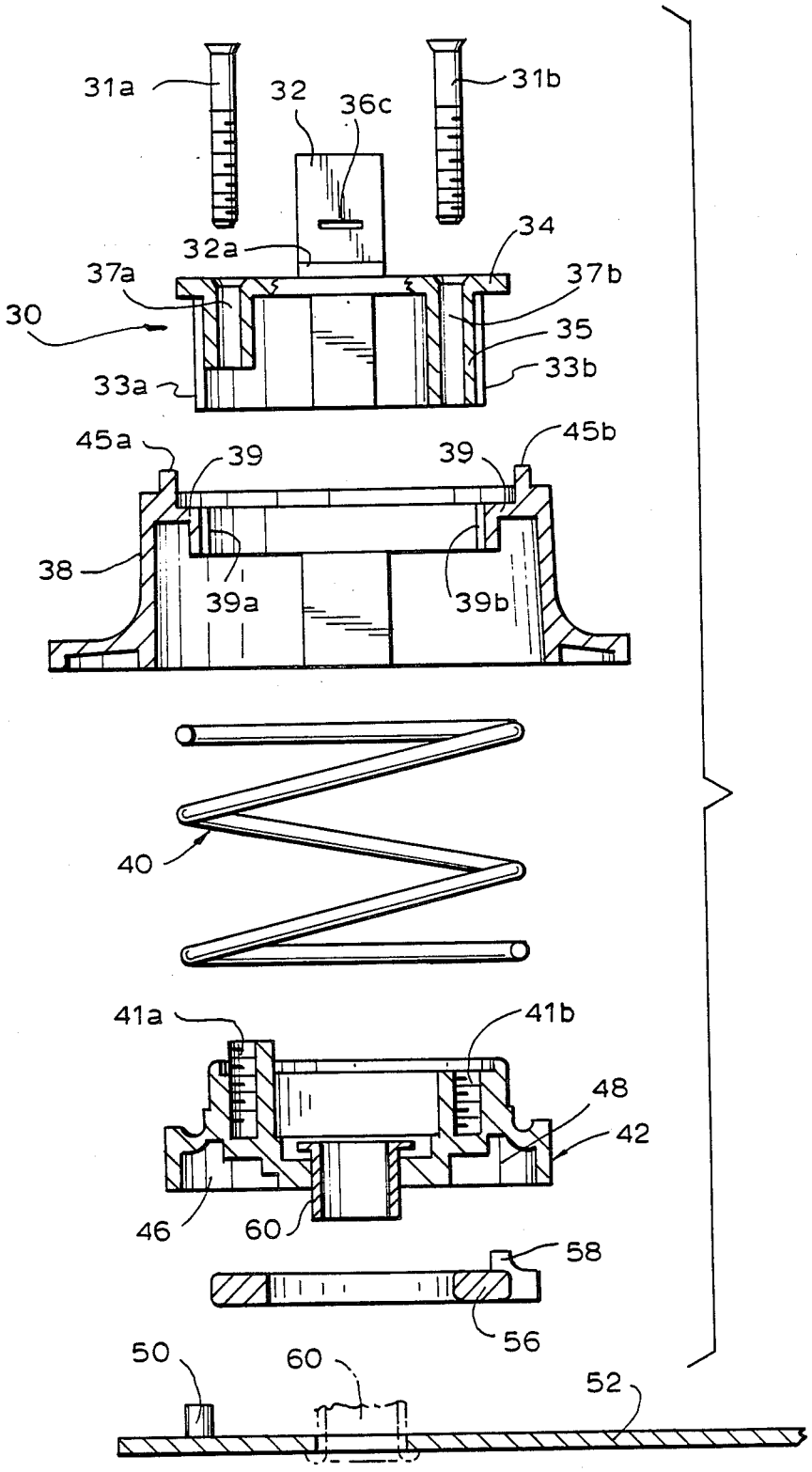
FIG. 6 is a exploded sectional view of the adapter assembly taken along line VI—VI on FIG. 5.
Figure 7:
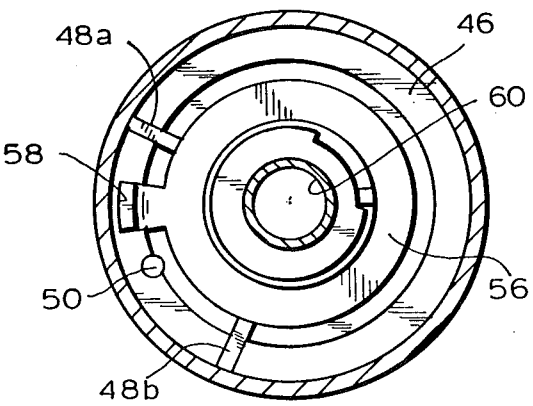
FIG. 7 is a sectional view taken along the line VII—VII on FIG. 4.
Figure 10:
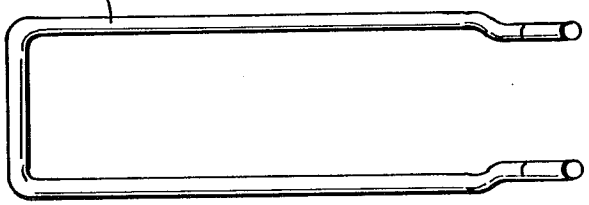
FIG. 10 is a plan view of an arcuate guide.

As shown in FIGS. 5–7, the adapter assembly 16 includes a top member 30 having an upper portion 32 and a circular base member 34. The upper portion 32 has electrical contacts 36*a*, 36*b* and 36*c* extending therefrom. The contact 36*a* is a ground contact located at the pinnacle of upper portion 32, and the contacts 36*b* and 36*c* are located at opposite sides of the upper portion 32 at different heights for a purpose hereinafter described.

The top member 30 has a substantially cylindrical flange 35 extending downwardly from base member 34 with two axially directed grooves 33*a* and 33*b* located on opposite sides of the outer surface of flange 35 (FIG. 6).

The adapter assembly 16 further includes a generally cylindrical shell 38, a spring 40, and a bottom member 42 (FIG. 6). The shell 38 includes a top lip 39 with two inwardly extending splines 39*a* and 39*b* that correspond with, and are engageable in the grooves 33*a* and 33*b* of top member 30. This enables the shell 38 to be rotatably coupled with this member 30. The bottom member 42 has upwardly directed bosses 41*a* and 41*b* framed with threaded bores which align with bores 37*a* and 37*b*, in the top member 30 for receiving screws 31*a* and 31*b*, respectively, to connect the top member 30 and bottom member 42. The spring 40 is a helical compression spring located between the top lip 39 of the shell 38 and the bottom member 42 (FIG. 6). The shell 38 is capable of axial movement with respect to the secured together top member 30 and bottom member 42 between an elevated position shown in FIG. 8A to which it is urged by the spring 40 and a depressed position shown in FIG. 8B.

As seen in FIG. 5, the shell 38 further includes fingertabs 44*a*, 44*b*, 44*c*, and 44*d* equally angularly spaced around the outer edge. Three of these fingertabs 44*a*, 44*b* and 44*c* are substantially rectangular and the fourth fingertab 44*d* is generally semi-circular in appearance. These fingertabs enable the user to manipulate the shell 38 axially relative to members 30 and 42, to locate the adapter assembly 16 of the light fixture 14 in the channel 12 and to remove the adapter assembly 16 from the channel 12. The preferred procedure is to use two opposite fingertabs at one time to depress the spring 40 and manipulate the light fixture 14. The shell 38 also includes two upwardly extending locking tabs 45*a* and 45*b* located on the top lip 39 (FIG. 3, FIG. 5 and FIG. 6).

Further as shown in FIG. 5, the upper portion 32 is generally elongated in the diametrical direction at right angles to the diameter bisecting the locking tabs 45*a* and 45*b*. The ends of the upper portion 32 are undercut adjacent base member 34, at 32*a* and 32*b* (FIGS. 8A, 8B, 9A and 9B).

Figure 8B:
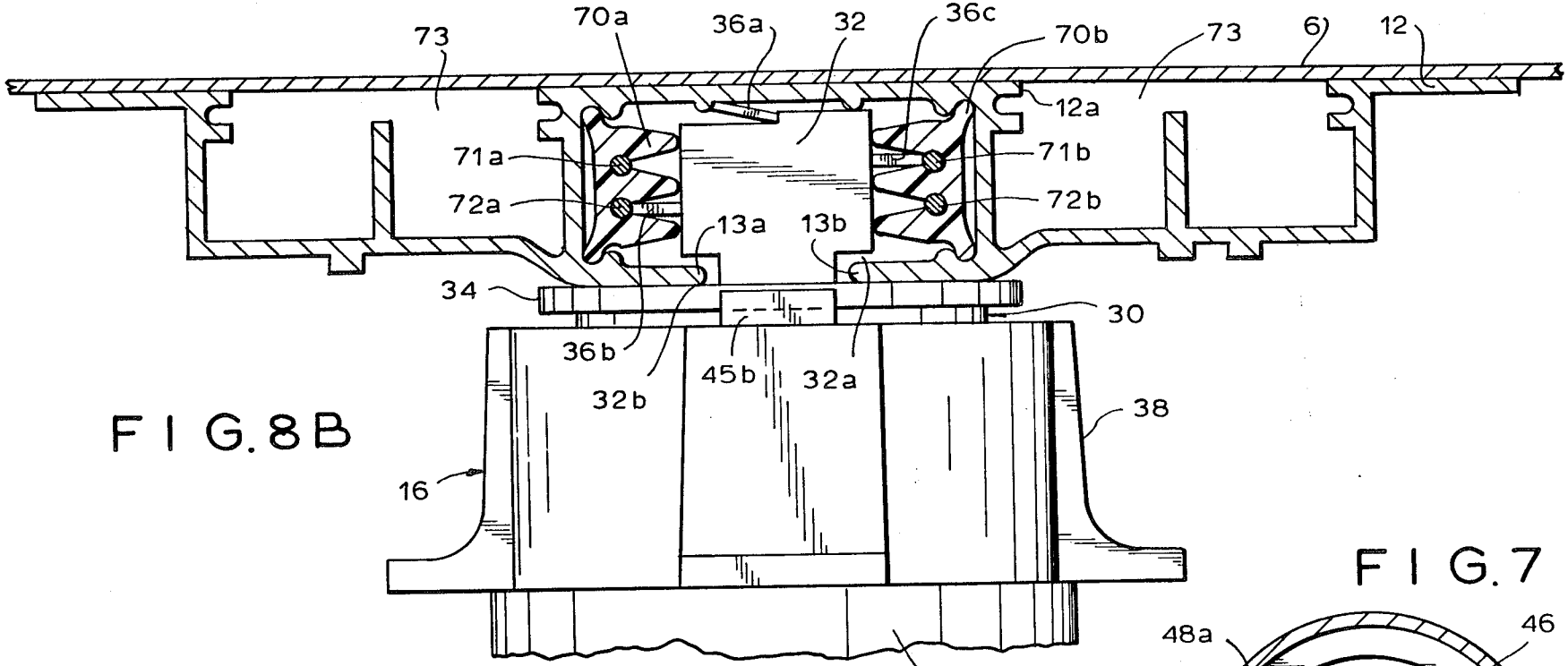
FIG. 8B is a view similar to that of FIG. 8A but showing the adapter assembly engaging in the channel in a second position.

Referring back to FIGS. 9A and 9B, it is shown that the channel 12 has an elongated slot 13 opening between side portions 13*a* and 13*b*, having a width W slightly greater than the width $W_1$ of the upper portion 32 which is approximately the same as the distance $D_1$ between the two adjacent undercuts 32*a* and 32*b* of upper portion 32. The channel 12 contains flexible insulating jackets 70*a* and 70*b* in which conductors 71*a* and 72*a* and conductors 71*b* and 72*b* are respectively disposed (FIGS. 8A and 8B). Channel 12 further defines a raceway 73 adapted to accommodate the wiring necessary for the recessed track lighting system.

The purpose of the above described construction of the adapter assembly 16 and the channel 12 is to provide a convenient means for engaging and disengaging the light fixture 14 in respect to the channel 12. Initially, the upper portion 32 of the adapter assembly 16 is inserted upwardly into the elongated slot 13 with the orientation relative to the latter shown in FIG. 9A. In this initial orientation, the upper portion 32 is parallel to the elongated slot 13, and the locking tabs 45*a* and 45*b* on the shell 38 are positioned adjacent to the underside of the channel 12. To engage the electrical contacts 36*b* and 36*c* selectively with the conductors within the flexible insulating jackets 70*a* and 70*b* and to 37 lock" the light fixture 14 with respect to the channel 12, the user turns the shell 38 of the adapter assembly 16 through an angle of 90° about the axis of rotation A while pressing the fixture upwardly to engage the surface of base number 34 against the underside of channel 12 which acts on tabs 45*a* and 45*b* to depress shell 38 relative to top member 30.

Figure 9C:
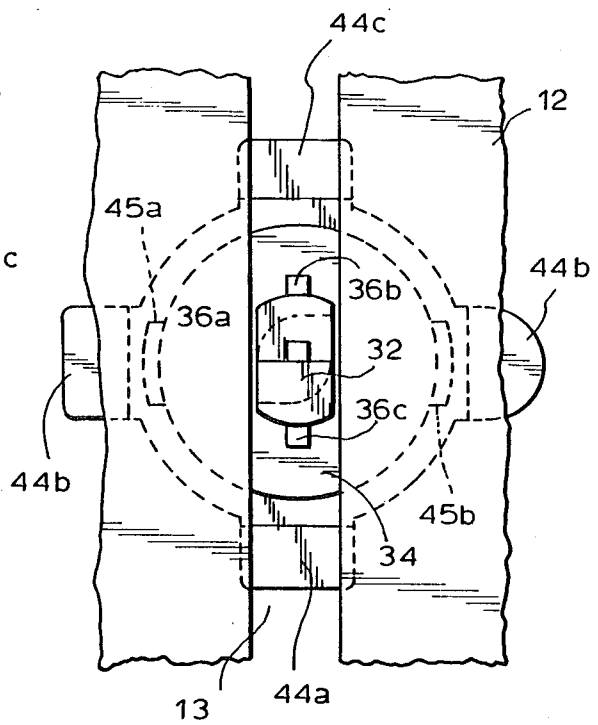
FIG. 9C is a diagrammatic view similar to that of FIG. 9A but showing the adapter assembly the channel in a second position.
Figure 9B:
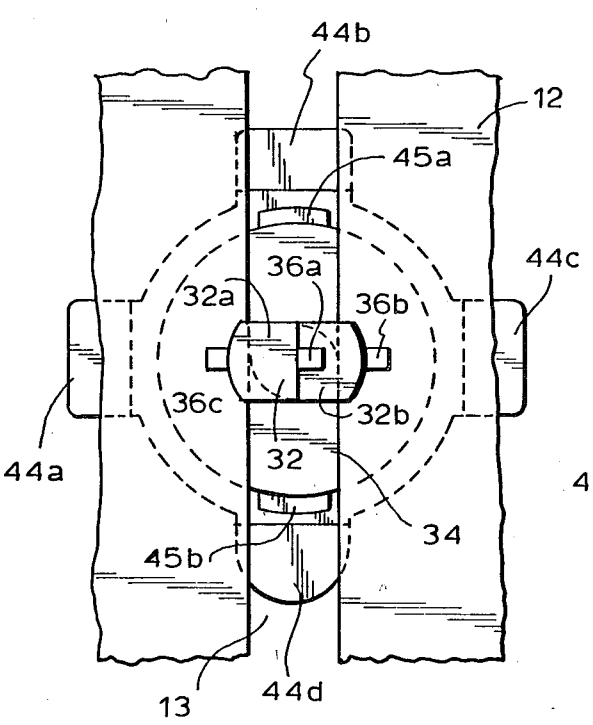
FIGS. 9A and 9B are diagrammatic views showing the manner in which engagement and disengagement of the adapter assembly in the channel are effected as viewed from above within the channel.

When the upper portion 32 extends perpendicular to the elongated slot 13 and the electrical contacts 36*b* and 36*c* are located within the flexible insulating jackets 70*a* and 70*b*, a "locking" action occurs. This "locking" action involves the reception of the locking tabs 45*a* and 45*b* within the elongated slot 13 when the upper portion 32 extends perpendicular to or across the elongated slot 13. In this "locked" position, the side portions 13a and 13b of the channel 12 are located within the undercuts 32a and 32b (FIGS. 8A, 8B and 9B). It will be understood that the action of spring 40 on shell 38 urging the latter to its elevated position (FIG. 8A) relative to top member 30 causes locking tabs 45a and 45b to snap into and be retained in slot 13 when turned to the position shown in FIG. 9B.

The combined action of the engagement of side portions 13a and 13b in undercuts 32a and 32b and of locking tabs 45a and 45b on slot 13 insures the secure attachment of the light fixture 14 to the channel 12.

As previously stated, the channel 12 contains flexible insulating jackets 70a and 70b in which conductors 71a and 72a, and conductors 71b and 72b respectively, are disposed at different levels (FIGS. 8A and 8B). Conductors 71a and 72b are included in a first circuit (FIG. 8A) and conductors 72a and 71b are included in a second circuit (FIG. 8B). Conductor 71a is the supply and conductor 72b is the neutral for circuit one. Conductor 71b is the supply and conductor 72a is the neutral for circuit 2.

The light fixture 14 is connected to the first circuit when electrical contact 36c, the neutral contact, is in contact with conductor 71a and electrical contact 36b, the supply contact, is in contact with conductor 72b (FIG. 8A). The light fixture 14 is connected with the second circuit when electrical contacts 36c and 36b are in contact with conductors 71b and 72a, respectively (FIG. 8B). In each case, the ground contact 36a bears against a top wall surface 12a of the channel 12. As earlier noted, the electrical contacts 36b and 36c are positioned at different heights on the upper portion 32 and the conductors 71a and 71b are at an upper level corresponding to that of the contact 36c while the conductors 72a and 72b are at a lower level corresponding to that of the contact 36b. Therefore, the contact 36c is selectively engageable with the conductor 71a or 71b, and the contact 36b is selectively engageable with the conductor 72a or 72b depending on the orientation of the upper portion 32 relative to the channel 12 when installed in the latter.

As previously stated, the shell 38 is rotatably coupled with the top member 30 and therefore the location of the fingertabs 44a, 44b, 44c and 44d with respect to the upper portion 32 and the electrical contacts 36a, 36b, 36c located thereon, remains constant. The single semicircular fingertab 44d extends perpendicular to the length of the upper portion 32 (FIGS. 3 and 4) and serves as an indicator of the position of such portion 32 and its contacts 36b and 36c relative to the channel 12.

Figure 9A:
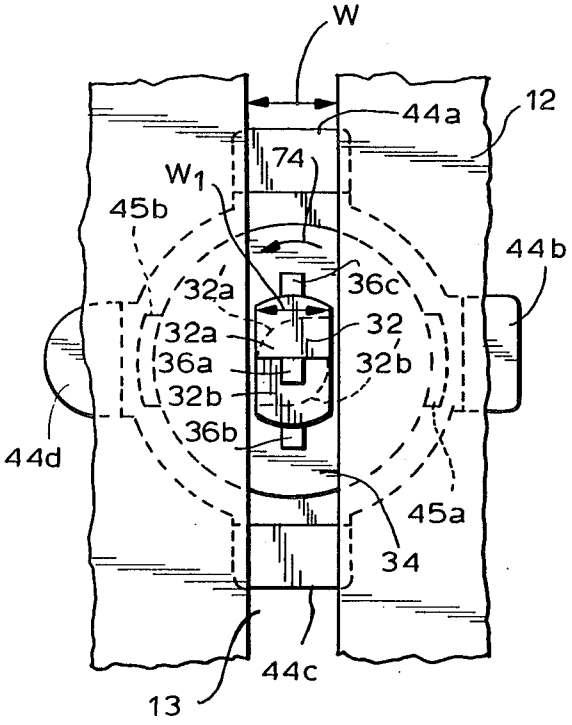

As indicated previously, the length of the upper portion 32 must extend parallel to the elongated slot 13 during engagement and disengagement of the adapter assembly 16 with the channel 12 (FIG. 9A). It is apparent from FIGS. 9A and 9C that this upper portion 32 can be oriented in two different ways while maintaining this parallel relationship with the elongated slot 13. The upper portion 32 can be placed in slot 13 in a first orientation shown in FIG. 9A or in a second orientation shown in FIG. 9C. The difference between the first and second orientations of upper portion 32 may be achieved by a 180° rotation of the adapter assembly 16. The initial placement of upper portion 32 in the elongated slot 13 in either the first orientation or the second orientation determines whether the light fixture 14, when installed, will be connected to the previously mentioned first circuit or second circuit, respectively.

Preferably, the rotational movement of the upper portion 32 within the elongated slot 13 can be effected in only one direction, for example, in the clockwise direction as viewed from below, which is the counterclockwise direction as viewed on FIGS. 9A and 9C and shown by the arrow 74 thereon. Such limitation on the turning of the upper portion 32 in the slot 13 may be imposed by a suitable configuration of the undercuts 32a and 32b, for example, by curving the inner edge surfaces thereof only at one side, as at 32'a and 32'b on FIG. 9A. Therefore, the first and second circuits can be selectively engaged merely by suitably varying the initial orientation of upper portion 32 within slot 13. The first circuit is engaged when upper portion 32 is initially in the orientation shown in FIG. 9A, and connection is effected with the second circuit when upper portion 32 is initially in the orientation shown on FIG. 9C.

Since the rotational position of semi-circular fingertab 44d is unchangeable relative to upper portion 32, the user can easily identify whether the first or second circuit is to be engaged merely by noting the position of fingertab 44d (FIGS. 9A and 9C) at the time of the insertion of upper portion 32 into slot 13.

Referring back to FIG. 2, located on either side of the channel 12 are ridges 15a, 15b and 15c. Double ridges 15a and 15b are located on one side of the channel 12 and a single ridge 15c is located on the other side. These ridges 15a, 15b and 15c serve as an easy reference to the user to quickly determine which circuit is engaged. Further, these ridges 15a, 15b and 15c are an easy tool to maintain uniformity in circuits when multiple housings are employed. The user can quickly determine which circuit is engaged by determining the location of the semicircular fingertab 44d with respect to these single or double ridges 15a, 15b and 15c respectively and then continue that relationship with each additional light fixture 14 and each additional housing 2.

Referring back to FIG. 1, adjustable mounting brackets 75 and 76 are located along the outside of the top wall 6 of the housing 2, running perpendicular to the channel 12 and the elongated opening 10. These mounting brackets 75 and 76 include a horizontal member 77 and 78 respectively and two vertical adjustment brackets. As shown in FIG. 2, the adjustable mounting bracket 75 includes the horizontal member 77 and vertical adjustment brackets 79 and 80. These adjustable mounting brackets 75 and 76 allows the recessed track system to be integrated with various ceiling support structures used in sheet rock, concealed spline or suspended tile ceilings. The housing 2 is suspended from the building structure on the adjustable mounting brackets 75 and 76 along with the other ceiling support members. The vertical mounting brackets 79 and 80 allows for fine tuning the position of the housing 2 as it relates to the dropped ceiling 4.

The procedure for engaging the light fixture 14 with the channel 12 will become readily apparent by the following illustrative example. To connect the light fixture 14 to the first circuit, the user will insert top portion 32 into the elongated slot 13 with the orientation relative to the latter shown in FIG. 9A with the positions of electrical contacts 36b and 36c and fingertab 44d indicated thereon. The user will then turn the adapter assembly 16 approximately 90° counterclockwise as viewed in FIG. 9A to the position shown in FIG. 9B. In this position, which is securely maintained by the earlier described engagement of locking tabs 45a and 45*b* in slot 13, electrical contact 36*c* is in contact with conductor 71*a* and electrical contact 36*b* is in contact with conductor 72*b* (FIG. 8A) thereby connecting the light fixture 14 to the first circuit.

The usefulness of having a two circuit system is readily apparent. For example, the first circuit could be connected to a dimmer switch while the other or second circuit is connected to a simple ON-OFF switch. In this way, the user can change the intensity of the lighting or the pattern of the lighting arrangement merely by selectively and individually controlling the first and second circuits to which the several light fixtures 14 within the single housing 2 are selectively connected.

For disengaging the light fixture 14 from the channel 12, the user downwardly depresses the shell 38 against the opposing force of the spring 40 to release the locking tabs 45*a* and 45*b* from the elongated slot 13 of the channel 12. The release of these locking tabs 45*a* and 45*b* allows the user to rotate the adapter assembly 16 approximately 90° in the clockwise direction as viewed on FIG. 9B, back to the initial position (FIG. 9A) where the upper portion 32 is parallel to the slot 13. The user can then remove the upper portion 32 from the elongated slot 13 and thereby disengage the light fixture 14 from channel 12.

The light fixture 14 further includes an arm 52 that extends from the adapter assembly 16 in a radially outward direction with respect to the axis of rotation A (FIG. 4). A means for limiting the rotation of the light fixture 14 around the axis of rotation A is provided within the adapter assembly 16 and the arm 52. At the underside of the bottom member 42 of the adapter assembly 16 there is a downwardly opening annulus 46 in which angularly spaced stop elements 48*a* and 48*b* are located (FIG. 7). A drive member 50 extends upwardly from the arm 52 into the annulus 46 and is movable in a circular path within the latter upon turning of the arm 52 about the axis A. An intermediate ring member 56 having an abutment 58 extending therefrom into the annulus 46 is rotatable about the axis A relative to the member 46 and the arm 52. For example, as shown in FIGS. 6 and 7 a hollow rivet 60 may be employed for rotatably joining together bottom member 42, ring member 56 and arm 52. The abutment 58 is positioned between and engageable with the stop elements 48*a* and 48*b* and is also engageable by the drive member 50. The movement of the abutment 58 between stop elements 48*a* and 48*b* enables the light fixture 14 to be turned approximately 380° about the axis of rotation A, thereby eliminating any blind spots in the area that may be illuminated. The foregoing is achieved while maintaining the integrity of the wiring 47 (FIG. 4) contained in the light fixture 14 by providing a limit to the rotation of the fixture 14 and hence to the twisting of the wiring 47.

Further, a thermal protector (not shown) is located in the arm 52 of the light fixture 14. This thermal protector disconnects supply power to the light fixture 14 should the light fixture 14 overheat. This thermal protector is self-resetting once the light fixture 14 has returned to a safe operating temperature.

Referring back to FIG. 2, it will be seen that a fan 29 may be provided in the housing 2 for cooling the system. This is desirable when the light source, as shown in broken lines at 19 of FIG. 4, is a halogen lamp, in which case the base 62 may contain the transformer (not shown) which is usually employed with that type of light source.

The fan 29 further includes a small thermoprotector (not shown) to disconnect supply power to the fan 29 should the fan 29 overheat. This situation might occur should the fan 29 become blocked. This thermoprotector is self-resetting once a safe temperature has been re-established.

It will be appreciated that, in the above described recessed track lighting system according to an embodiment of the invention ease of fixture placement within the housing and aiming flexibility are achieved in a system in which the individual light fixtures are substantially hidden from view. Each light fixture 14 is rotatable 380° around the axis of rotation A of its adapter assembly 16 and the arcuate guide 22 allows for aiming angles deviating as much as 45° from the axis of rotation. The combination of these two movements allows the user to light a subject anywhere within a circular area having a diameter approximately twice the ceiling height. In all these possible positions of the light fixture 14, it remains substantially hidden from view within the recessed housing. Further, since the light fixture 14 is capable of being rotated beyond 360°, there is no "dead spot" that cannot be illuminated.

When a halogen lamp with a point source filament is desirably employed along with an ellipsoidal reflector, the light beam can be made to accurately converge to a focal point located at the plane of the elongated opening 10 of the housing 2. In such case, virtually 100% of the light energy in the beam passes through the elongated opening 10 of the housing 2, regardless of the aiming angle of the lamp head 18.

The elongated opening 10 is sized so it is capable of passing the light fixture 14 therethrough. However, when the light fixture 14 is located along the channel 12 and a halogen lamp is employed, the width of the elongated opening 10 is underutilized. Further, the aesthetic appeal of the recessed track lighting system is diminished due to this large opening. This problem is overcome by the use of trim members 27*a* and 27*b*, previously described in FIG. 2. These trim members 27*a* and 27*b* are sized to limit the elongated opening 10 to a width that allows virtually 100% of the light beam energy to pass through without any additional underutilized space. As previously described, these trim members 27*a* and 27*b* are slidably engageable with inverted T-bars 26*a* and 26*b* and are, therefore, easily engaged and disengaged. These trim members 27*a* and 27*b* serve to enhance the aesthetic appeal of the recessed track system.

The light fixture 14 can be located anywhere along the length of the channel 12 within the housing 2 and the aiming and rotation angle of each of these light fixtures 14 is independent of the other light fixtures 14 along the channel 12. Further, different lamps can be utilized within each light fixture 14. Because the system may utilize more than one light fixture 14 and each light fixture 14 is positioned in the channel 12 independently of the other light fixtures 14, the flexibility of the accent lighting is greatly enhanced.

Further, the described recessed track lighting system features first and second control circuits, and different light fixtures 14 engaging a common channel 12 can be individually operated through the two separately controlled circuits.

Therefore, the combination of all these desirable features in a recessed track lighting system, as disclosed, provides a flexible accent lighting system that is adaptable to changes in the arrangement and use of a space.

Although an illustrative embodiment of the invention has been described in detail herein, it is to be understood that the invention is not limited to the foregoing, and that various modifications and changes may be effected therein by one skilled in the art without departing from the scope or spirit of the invention as defined in the appended claims.

What is claimed is:

1. A recessed track lighting system comprising:

a housing adapted to be recessed in a ceiling and including a top wall, means defining an elongated opening spaced downwardly from said top wall, and means defining a channel along said top wall extending parallel to said elongated opening and laterally centered in respect thereto; and at least one light fixture adapted to be mounted within said housing and including adapter means releasably engageable in said channel and being movable along the latter, said adapter means defining an axis of rotation that substantially bisects the width of said elongated opening, a lamp head, lamp head support means rotatable around said axis of rotation and including arcuate guide means extending generally radially from said axis of rotation and having a curvature centered substantially at the lateral center of said opening, means for mounting the lamp head on said arcuate guide means for adjustable movement therealong, said lamp head having a light source directing light along a light beam axis which, in all positions of the lamp head along the arcuate guide means, intersects the axis of rotation at the plane of the opening.

2. A recessed track lighting system as in claim 1; further comprising means for cooling said housing.

3. A recessed track lighting system as in claim 2; wherein said means for cooling further includes a thermal protector unit.

4. A recessed track lighting system as in claim 1; wherein said adapter means includes a body with finger tabs extending therefrom for manipulating said adapter means relative to said channel, and contact means extending from said body; and further comprising conductor means in said channel engageable by said contact means for securing said adapter means in said housing and conducting electric current to said adapter means from said conductor means.

5. A recessed track lighting system as in claim 4; further comprising flexible insulating conductor jackets in which said conductor means are disposed.

6. A recessed track lighting system as in claim 1; wherein said lamp head includes means directing said light from the light source to a focal point which is always located in said plane of the elongated opening of said housing.

7. A recessed track lighting system as in claim 1; wherein said channel includes a raceway with means therein for supporting wiring.

8. A recessed track lighting system as in claim 1; wherein said lamp head includes a substantially cylindrical casing and means on said casing slidably receiving said arcuate guide means.

9. A recessed track lighting system as recited in claim 8; wherein said adjustable movement of the lamp head on said arcuate guide means has an extent for angularly displacing said light beam axis between approximately 0° and 45° relative to said axis of rotation.

10. A recessed track lighting system as in claim 1; wherein said adapter means includes means for limiting rotation of said lamp head support means about said axis of rotation over an angle substantially exceeding 360°.

11. A recessed track lighting system as in claim 10; wherein said means for limiting rotation includes a first non-rotatable member having angularly spaced stop means, a second member fixed to the lamp head support means and being rotatable relative to the first member and having a drive element extending therefrom, an intermediate member rotatable relative to the first and second members and having an abutment engageable by the drive element and being angularly movable between said angularly spaced stop means.

12. A recessed track lighting system as in claim 1; wherein said housing comprises a substantially rectangular shell having side walls depending from said top wall, and a partially open bottom wall constituting said means defining the elongated opening.

13. A recessed track lighting system as in claim 12; wherein said bottom wall has two depending, inverted T-shaped elements extending along opposite sides of said elongated opening and including substantially horizontal portions which, at confronting inner edges, define opposite side margins of said elongated opening.

14. A recessed track lighting system as in claim 1; wherein said light fixture further includes an arm that extends from said adapter means in a radially outward direction in respect to said axis of rotation, and a base member which extends downwardly from the radially outer end of said arm and from which said arcuate guide means extends substantially in diametric opposition to said arm.

15. A recessed track lighting system as in claim 14; wherein said base member contains a transformer.

16. A recessed track lighting system as in claim 15; wherein said base member of said light fixture includes a thermal protector unit.

17. A recessed track lighting system as in claim 1; wherein said light fixture further includes flexible electrical connection means located between said lamp head and said base member.

18. A recessed track lighting system as in claim 1; wherein said housing further includes adjustable mounting brackets.

* * * * *

UNITED STATES PATENT AND TRADEMARK OFFICE

CERTIFICATE OF CORRECTION

PATENT NO. : 4,887,196

DATED : December 12, 1989

INVENTOR(S) : Brown et al.

It is certified that error appears in the above-identified patent and that said Letters Patent is hereby corrected as shown below:

Title page, item [75]:

Please correct the order of the inventors' names as follows:

Scott L. Roos

Tobias A. Brown

Donald D. Biancalana

Donald J. Westgaard

Signed and Sealed this

Nineteenth Day of March, 1991

*Attest:*

HARRY F. MANBECK, JR.

*Attesting Officer*

*Commissioner of Patents and Trademarks*